US008714253B2

(12) United States Patent
Sherwood et al.

(10) Patent No.: US 8,714,253 B2
(45) Date of Patent: May 6, 2014

(54) METHOD AND SYSTEM FOR INJECTION OF VISCOUS UNWEIGHTED, LOW-WEIGHTED, OR SOLIDS CONTAMINATED FLUIDS DOWNHOLE DURING OILFIELD INJECTION PROCESS

(75) Inventors: Joe Sherwood, Columbus, TX (US); Greg McEwen, Bangkok (TH); Gary Woolsey, Houston, TX (US); Katerina Newman, Houston, TX (US)

(73) Assignee: M-I LLC, Houston, TX (US)

( * ) Notice: Subject to any disclaimer, the term of this patent is extended or adjusted under 35 U.S.C. 154(b) by 220 days.

(21) Appl. No.: 12/429,968

(22) Filed: Apr. 24, 2009

(65) Prior Publication Data

US 2009/0260826 A1 Oct. 22, 2009

Related U.S. Application Data

(63) Continuation-in-part of application No. PCT/US2008/075814, filed on Sep. 10, 2008.

(60) Provisional application No. 60/972,117, filed on Sep. 13, 2007.

(51) Int. Cl.
*E21B 43/16* (2006.01)

(52) U.S. Cl.
USPC ..... 166/305.1; 405/129.1

(58) Field of Classification Search
USPC ..... 175/207, 209; 166/305.1; 405/129.1, 405/129.2, 129.35
See application file for complete search history.

(56) References Cited

U.S. PATENT DOCUMENTS

| | | | | |
|---|---|---|---|---|
| 2,807,441 | A * | 9/1957 | Sewell | 173/27 |
| 3,963,605 | A * | 6/1976 | Seabourn | 209/2 |
| 4,042,048 | A * | 8/1977 | Schwabe | 175/380 |
| 2002/0011338 | A1 | 1/2002 | Maurer et al. | |
| 2003/0070840 | A1 * | 4/2003 | Boer | 175/5 |
| 2004/0084214 | A1 | 5/2004 | deBoer | |
| 2006/0120904 | A1 * | 6/2006 | Haesloop | 417/423.3 |
| 2007/0051539 | A1 | 3/2007 | Blaschke et al. | |
| 2008/0029267 | A1 * | 2/2008 | Shampine et al. | 166/305.1 |
| 2009/0277641 | A1 * | 11/2009 | Walters et al. | 166/305.1 |

OTHER PUBLICATIONS

International Preliminary Report on Patentability issued in related International Application No. PCT/US2008/075814 dated Mar. 25, 2010. (6 pages).
Examination Report issued in corresponding Australian Patent Application No. 2008299076; Dated Feb. 14, 2011 (2 pages).

* cited by examiner

*Primary Examiner* — Shane Bomar
*Assistant Examiner* — Kipp Wallace
(74) *Attorney, Agent, or Firm* — Osha Liang LLP

(57) ABSTRACT

A system for injecting a fluid into a formation including a fluid, and at least one injection pump configured to receive the fluid, the at least one pump including a centrifugal pump having at least two stages configured to increase the pressure of the received fluid is disclosed. The system further includes a drive device coupled to the injection pump. A method of injecting a fluid downhole including providing a fluid to an injection pump, the injection pump including a centrifugal pump having at least two stages, pumping the fluid through the at least two stages of the centrifugal pump, thereby increasing the pressure of the fluid, and injecting the fluid from the injection pump into a wellbore is also disclosed.

11 Claims, 5 Drawing Sheets

METHOD AND SYSTEM FOR INJECTION OF VISCOUS UNWEIGHTED, LOW-WEIGHTED, OR SOLIDS CONTAMINATED FLUIDS DOWNHOLE DURING OILFIELD INJECTION PROCESS

This application is a continuation in part of prior PCT/US2008/075814, filed Sep. 10, 2008, which claims priority to U.S. Provisional Application No. 60/972,117, filed Sep. 13, 2007, the disclosures of which are hereby incorporated by reference.

BACKGROUND OF INVENTION

1. Field of the Invention

Embodiments disclosed herein generally relate to a method and system for fluid injection. In particular, embodiments disclosed herein relate to a method and system for injecting viscous fluids, unweighted fluids, low-weighted fluids, and/or slurries in a downhole formation.

2. Background Art

In the drilling of wells, a drill bit is used to dig many thousands of feet into the earth's crust. Oil rigs typically employ a derrick that extends above the well drilling platform. The derrick supports joint after joint of drill pipe connected end-to-end during the drilling operation. As the drill bit is pushed further into the earth, additional pipe joints are added to the ever lengthening "string" or "drill string". Therefore, the drill string includes a plurality of joints of pipe.

Fluid or "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with pieces of shale and rock that are known in the industry as well cuttings or drill cuttings. Once the drill cuttings, drilling mud, and other drilling effluents containing solid particles reach the platform, a solids control equipment that may include shale shakers, desanders, desilters, mud cleaners, and/or oilfield decanter centrifuges, is typically used to remove the drilling mud from the drill cuttings so that the drilling mud may be reused. The remaining drill cuttings, waste, and associated residual drilling fluids are then transferred to a holding trough for disposal. In some situations, for example with specific types of drilling fluids, the drilling fluid may not be reused and it must be disposed of. Typically, the non-recycled drilling fluid is disposed of separately from the drill cuttings and other waste by transporting the drilling fluid via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment.

One method of disposing of oily-contaminated cuttings and other drill cutting waste is to re-inject the cuttings into the formation using a cuttings re-injection operation. Generally, the injection process involves the preparation of a slurry within surface-based equipment and pumping the slurry into a well that extends relatively deep underground into a receiving stratum or adequate formation.

In addition to re-injecting cuttings, it is often necessary to inject other types of fluids downhole during a variety of operations. For example, in some cases, it may be necessary to increase the permeability of a formation into which waste is injected. One method for increasing formation permeability known in the art is hydraulic fracturing, wherein a fluid is forced into the formation to create fractures that extend into the formation from the borehole. In another application, well cleaning or treatment fluids may be forced into a wellbore during regular maintenance or well rehabilitation.

Due to the limited space, it is common to modularize operations and to swap out modules when not needed or when space is needed for the equipment. For example, with respect to cuttings re-injection operations, cuttings containers may be offloaded from the rig to make room for modularized equipment used for slurrification. These lifting operations, as mentioned above, are difficult, dangerous, and expensive. Additionally, many of these modularized operations include redundant equipment, such as pumps, valves, and tanks or storage vessels.

Accordingly, there exists a need for more efficient methods of injecting a fluid, or a fluid and a slurry, downhole that require optimized use of rig deck space.

SUMMARY OF INVENTION

In one aspect, embodiments disclosed herein relate to a system for injecting a fluid into a formation including a fluid, at least one injection pump configured to receive the fluid, the at least one pump including a centrifugal pump having at least two stages configured to increase the pressure of the received fluid, and a drive device coupled to the at least one injection pump.

In another aspect, embodiments disclosed herein relate to a method of injecting a fluid downhole including providing a fluid to an injection pump, the injection pump including a centrifugal pump having at least two stages, pumping the fluid through the at least two stages of the centrifugal pump, thereby increasing the pressure of the fluid, and injecting the fluid from the injection pump into a wellbore.

Other aspects and advantages of the invention will be apparent from the following description and the appended claims.

DETAILED DESCRIPTION

Figure 1:
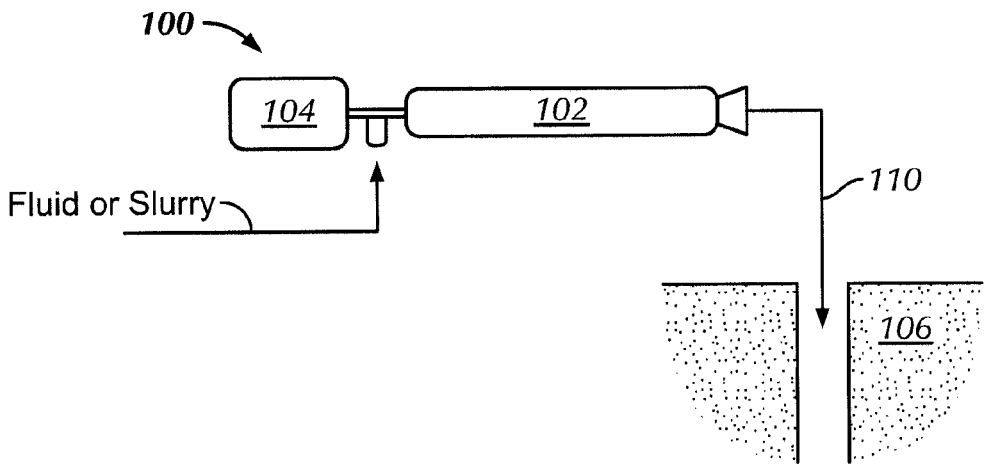
FIG. 1 shows a slurry or fluid injection system in accordance with embodiments disclosed herein.

In one aspect, embodiments disclosed herein generally relate to a method or process of cuttings re-injection. In particular, embodiments disclosed herein relate to methods and systems for injecting a slurry, viscous bio-polymer based fluids, and/or other associated effluents, into a formation. More specifically, embodiments disclosed herein relate to a method and system for cuttings re-injection using a multi-stage centrifugal pump.

During cuttings re-injection operations, a slurry is prepared including a fluid and cleaned drill cuttings. Solid waste, e.g., drill cuttings, is typically degraded, or reduced, to a size of less than 300 microns. The solid waste may be degraded using centrifugal pumps or grinding machines. Typically, the slurry is prepared by mixing together drill cuttings, previously classified by size, to a desired ratio with a fluid, such that a slurry is created that contains a desirable percentage of drill cuttings to total volume. Those of ordinary skill in the art will appreciate that generally, the solids content of slurries used in cuttings re-injection operations is about 20 percent solids content by volume. Thus, in a given cuttings re-injection operation, a slurry is prepared for re-injection by mixing drill cuttings with a fluid until the solids content of the slurry is about 20 percent. After preparation of the slurry, the slurry is pumped to a vessel for storage until a high-pressure injection pump is actuated, and the slurry is pumped from the storage vessel into the wellbore. Rheological properties of the slurry may be controlled using polymer additives so that the slurry may be injected under high pressure (typically between 1000 and 5000 psi) through a casing annulus or tubular into hydraulic fractures of suitable formations.

Cuttings re-injection processes include injecting a slurry into a formation using a pump configured to inject the slurry at a pre-determined pressure. These pumps often include duplex or triplex pumps. For example, typical injection pumps include a plunger or piston that compresses the slurry and injects it downhole at a selected pressure and pump rate. An example of such a commercially available plunger pump is an OPI 600 plunger pump from Gardner Denver (Houston, Tex.). The movement of the plunger provides a series of compressions of the slurry, thereby pumping the slurry downhole in pulse-like manner forming specific fractures in a receiving formation. The continual movement of the plunger and "hammering" of the pumps result in wear of the pump components and a noisy working environment. Furthermore, health, safety, and environmental (HSE) issues must be considered when using a typical plunger-type pump for cuttings re-injection processes.

Conventional high-pressure pumps and injection systems inject a slurry into a formation in batches. The movement of the plunger provides a series of compressions of the slurry, thereby pumping the slurry downhole in a pulse-like manner, forming specific fractures in a receiving formation. In contrast, the injection system of the present disclosure may provide an injection pump that offers continuous and smooth flow of slurry, because of fundamental differences in the technical design of the injection system. Thus, in some embodiments, the solids content of slurry may be increased. For example, in certain embodiments, the solid content may be approximately 30 percent solid content by volume, while the desired injection pressure of the slurry is maintained. In other embodiments, the slurry may be greater than 30 percent solid content by volume. Thus, in some embodiments, a system using at least one centrifugal pump may stimulate the receiving formation, allowing stable and more sustainable fracturing. The volume of waste that may be injected in the formation may therefore be increased.

One method of injecting a slurry into a formation in accordance with embodiments disclosed herein includes providing a slurry to an injection pump, pumping the slurry through the injection pump to increase the pressure of the slurry, and delivering or pumping the slurry downhole into the wellbore. In this embodiment, the injection pump is a centrifugal pump that includes at least two stages, or a multi-stage centrifugal pump. Each stage of the multi-stage centrifugal pump includes an entrance, a stationary diffuser, and an impeller that rotates and moves the slurry from the entrance to the exit of the stage. As the slurry flows through each stage, the slurry pressure increases.

In another aspect, embodiments disclosed herein generally relate to a method or process of fluid injection. In particular, embodiments disclosed herein relate to methods and systems for injecting a fluid into a formation. More specifically, embodiments disclosed herein relate to a method and system for fluid injection using at least one multi-stage centrifugal pump.

Cutting re-injection processes may include not only slurry injection, but also the injection of viscous fluids having no solids content or a small amount of solids content. Viscous fluids, water portions, and cuttings-containing slurry portions are injected using an alternating injection pattern. Additionally, various fluids may be injected into a wellbore to prevent and correct problems, and to encourage productivity or absorption in oil, water, or waste wells. Some materials that may be pumped downhole include viscous fluids such as biopolymer based fluids, xanthan gum based fluids, polymer based fluids, and synthetic polymer based fluids. These and other materials may be used to create viscous pills with properties suitable for operations such as cleaning, formation fracturing, fluid loss control, wellbore treatment, and waste injection, among others.

It may also be desirable to inject waste fluids into a waste well. For example, during oil production, waste water may be co-produced with the oil which must be separated and disposed of. The waste water, which may contain hydrocarbons, is often injected into a formation that is sufficiently deep and capable of receiving and storing the waste.

One method of injecting a fluid into a formation in accordance with embodiments disclosed herein includes providing the fluid to an injection pump, pumping the fluid through the injection pump to increase the pressure of the fluid, and delivering or pumping the fluid into a wellbore. In certain embodiments, the injection pump is a centrifugal pump that includes at least two stages, or a multi-stage centrifugal pump. Each stage of the multi-stage centrifugal pump includes an entrance, a stationary diffuser, and an impeller that rotates and moves the fluid from the entrance to the exit of the stage. As the fluid flows through each stage, the fluid pressure increases.

Figure 8:
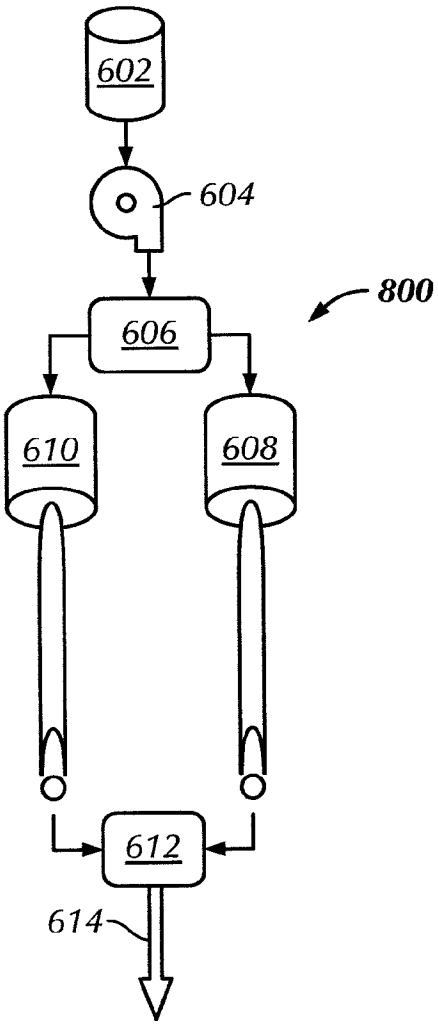
FIG. 8 shows a slurry and/or fluid injection system in accordance with embodiments disclosed herein.
Figure 9:
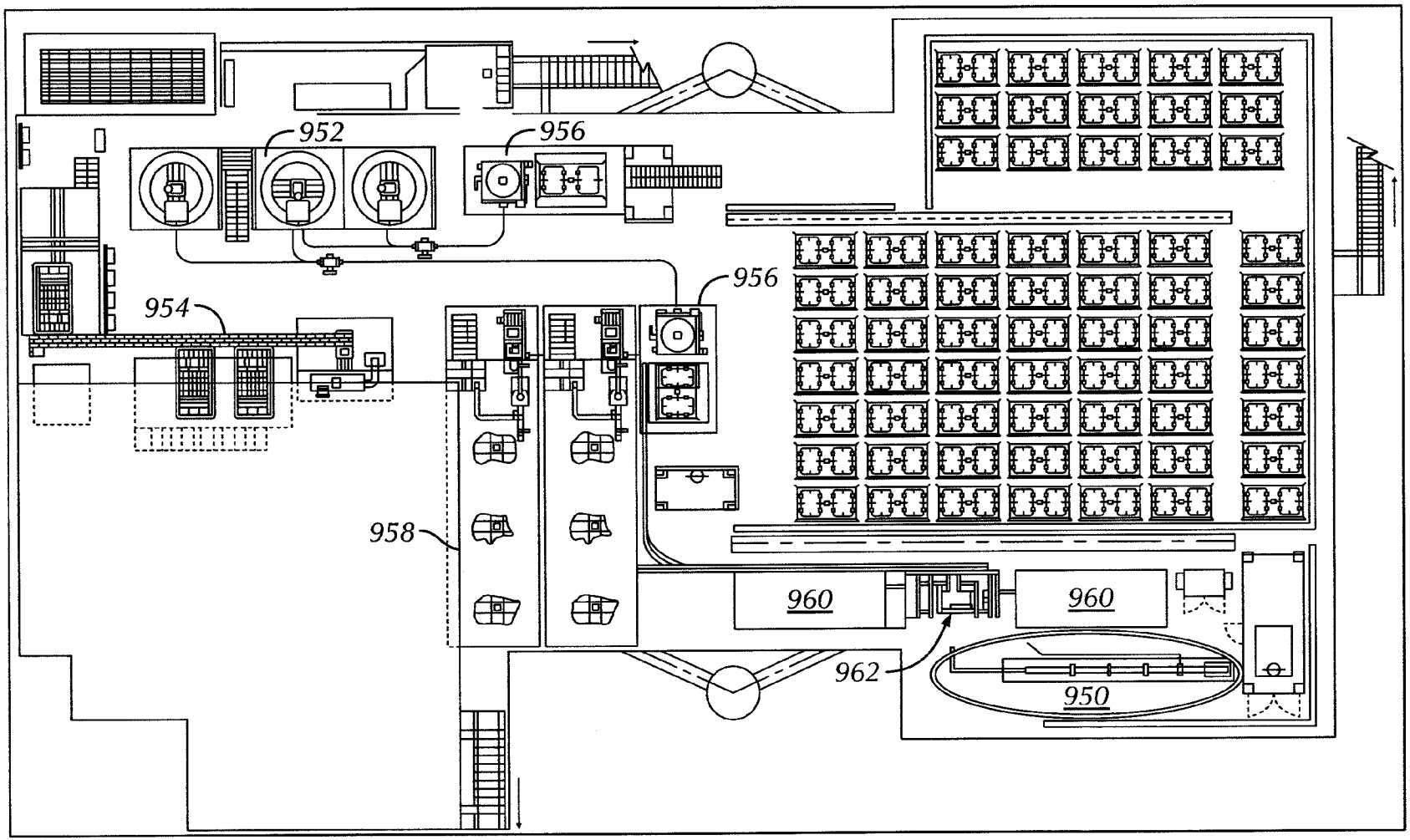
FIG. 9 shows a layout for equipment for an injection system in accordance with embodiments disclosed herein.

FIGS. 1-4 show different configurations of injection systems that may be used to inject fluids or slurry in accordance with embodiments disclosed herein. FIGS. 5-8 show different configurations of injection systems that may be used to inject a combination of fluids and/or slurries in accordance with embodiments disclosed herein. FIG. 9 shows an equipment layout for a fluid or slurry injection system in accordance with embodiments disclosed herein.

FIG. 1 shows an example of a configuration of an injection system 100 in accordance with embodiments disclosed herein. The injection system 100 may be used as a cuttings re-injection system or as a fluid injection system. As shown, a drive device 104 is coupled to an injection pump 102. Drive device 104 may include any device known in the art for driving a multi-stage centrifugal pump, for example, a direct drive, a diesel drive, a hydraulic drive, a belt drive, a gas drive, a variable frequency drive (VFD), or an inverter. In the embodiment shown, injection pump 102 is a horizontal centrifugal pump having at least two stages, or multi-stage centrifugal pump. A multi-stage centrifugal pump is a pump that includes at least two stages, and therefore, at least two impellers and at least two diffusers. The impellers and diffusers may be mounted on a single shaft. Bearings, e.g., radial thrust bearings, may be used to support the shaft in horizontal applications. One of ordinary skill in the art, however, will appreciate, that a vertically oriented centrifugal pump having at least two stages may also be used. During operation, the slurry or fluid may enter injection pump 102 at an ambient pressure. As the slurry or fluid is pumped through the at least two stages of injection pump 102, the pressure of the slurry or fluid increases. When the slurry or fluid exits the diffuser of the last stage of the injection pump 102, the slurry or fluid may be pumped through a valve or manifold (not shown) and then pumped downhole (indicated at 110) and into wellbore 106.

One of ordinary skill in the art will appreciate that injection pump 102 may include as many stages as necessary to achieve the desired increase in pressure, or pre-determined injection pressure. For example, the multi-stage centrifugal pump may include 2 stages, 5 stages, 15 stages, 17 stages, 19 stages, or any number of stages necessary to provide the desired injection pressure. Additionally, the size of the centrifugal pump and the number of stages of the centrifugal pump may be selected based on the desired pump rate and pressure of the slurry or fluid for injection downhole. For example, in addition to the number of stages, the size of the bore of the multi-stage centrifugal pump may be selected to obtain a desired pressure and pump rate. In certain embodiments, the centrifugal pump may have a 4 inch bore, a 6 inch bore, an 8 inch bore, or any other size known and used in the art. Thus, in one embodiment, injection pump 102, in accordance with embodiments disclosed herein, may deliver, for example, 10 bbl/min of slurry at 1500 psi.

Figure 2:
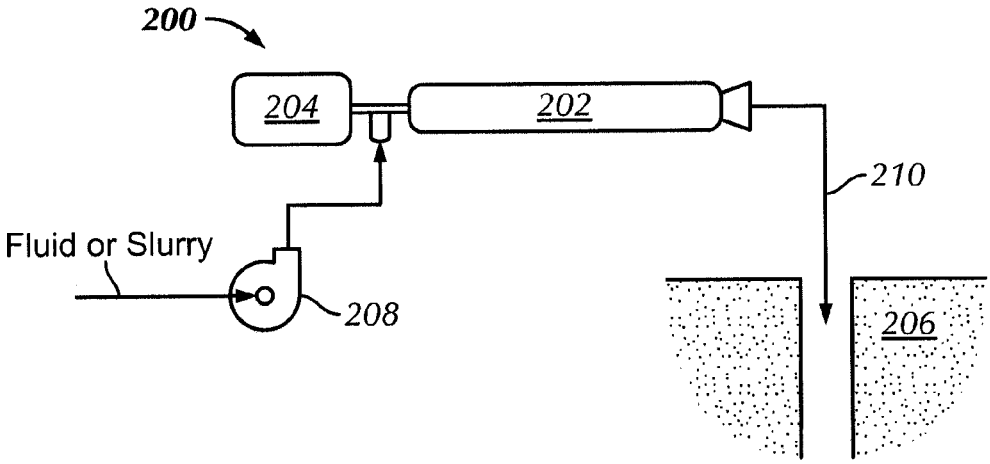
FIG. 2 shows a slurry or fluid injection system in accordance with embodiments disclosed herein.

In an alternative embodiment, as shown in FIG. 2, an injection system 200 may be used as a cuttings re-injection system or a fluid injection system. The injection system 200 includes an injection pump 202, a drive device 204 coupled to the injection pump 202, and a second centrifugal pump 208. In this embodiment, injection pump 202 is a horizontal centrifugal pump having at least two stages, or horizontal multi-stage centrifugal pump. Secondary centrifugal pump 208 may be disposed before (i.e., upstream of) injection pump 202, and may include a single entrance, a single diffuser, and a single impeller (not independently illustrated). The secondary centrifugal pump 208 may receive the slurry or fluid from, for example, a holding tank or vessel (not shown), and may pump the slurry or fluid through a valve or manifold (not shown) to injection pump 202 at a pressure greater than ambient pressure. That is, as the slurry or fluid is pumped through the secondary centrifugal pump 208, the pressure of the slurry or fluid may increase to a pressure above ambient pressure. Thus, secondary centrifugal pump 208 acts like a booster pump to increase the pressure of the slurry or fluid to a desired pressure before transferring the slurry or fluid to the injection pump 202. Next, as the slurry or fluid is pumped through the at least two stages of the injection pump 202, the pressure is further increased until a pre-determined injection pressure and/or pump rate is achieved. When the slurry or fluid exits the last stage of the injection pump 202, the slurry or fluid may be pumped through a valve or manifold (not shown) and then pumped downhole (indicated at 210) and into wellbore 206.

Figure 4:
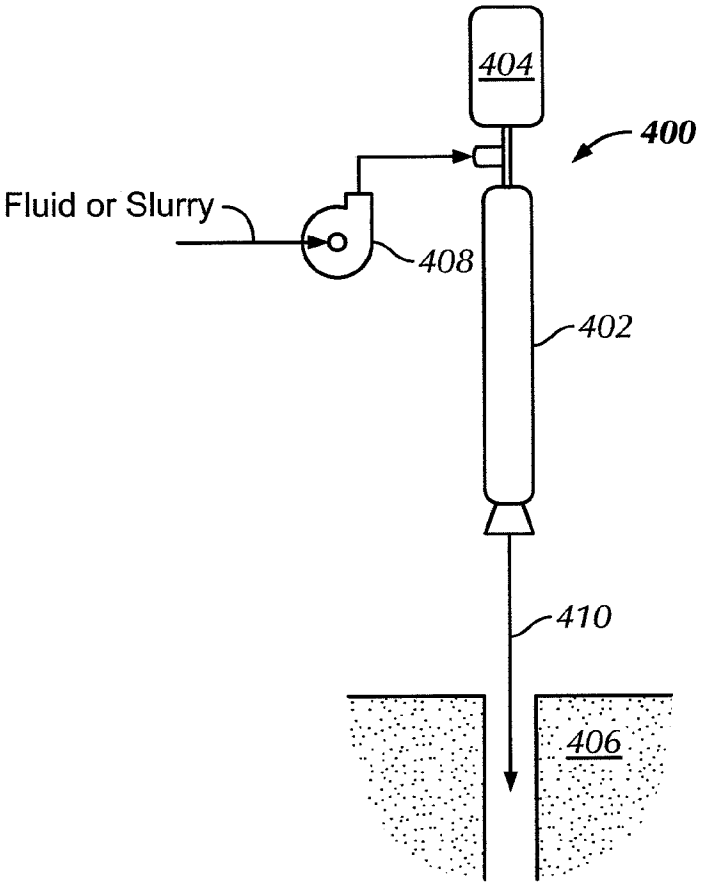
FIG. 4 shows a slurry or fluid injection system in accordance with embodiments disclosed herein.
Figure 3:
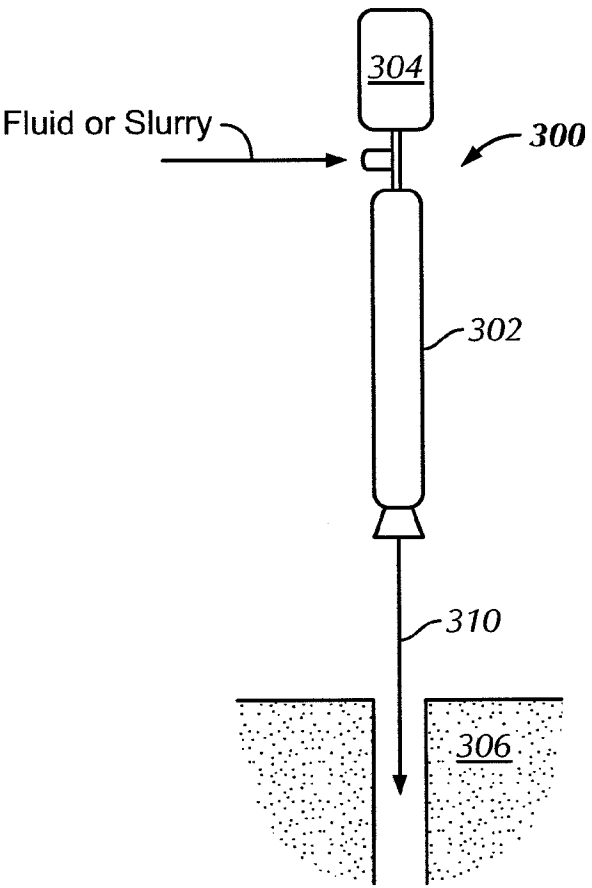
FIG. 3 shows a slurry or fluid injection system in accordance with embodiments disclosed herein.

Referring now to FIGS. 3 and 4, injection systems 300 and 400, in accordance with embodiments disclosed herein, may be used for cuttings re-injection or fluid injection. The injection systems 300 and 400 include an injection pump 302, 402 which may be a vertically oriented centrifugal pump having at least two stages, or vertical multi-stage centrifugal pump. Each stage of the multi-stage centrifugal pump includes an entrance, a diffuser, and an impeller that rotates and moves the slurry from the entrance to the exit of the stage. As the slurry or fluid flows through each stage, the slurry or fluid pressure increases. The injection pump 302, 402 may be configured such that a pre-determined pressure and/or pump rate of the slurry or fluid injected downhole (indicated at 310, 410) is achieved. For example, the number of stages and the size of the multi-stage centrifugal pump may be selected such that a pressure and pump rate of slurry or fluid suitable for a specified injection operation is achieved. When the slurry or fluid exits the last stage of the injection pump 302, 402 the slurry or fluid may be pumped through a valve or manifold (not shown) and then pumped downhole (indicated at 310, 410) and into wellbore 306, 406.

Further, as shown in FIG. 4, a secondary centrifugal pump 408 may be provided before (i.e., upstream of) the injection pump 402, and may include a single entrance, a single diffuser, and a single impeller (not independently illustrated). Secondary centrifugal pump 408 may receive the slurry or fluid from, for example, a holding tank or vessel (not shown), and pump the slurry or fluid to injection pump 402 at a pressure greater than ambient pressure. That is, as the slurry or fluid is pumped through secondary centrifugal pump 408, the slurry or fluid pressure may increase to a pressure above ambient pressure. Thus, the secondary centrifugal pump 408 acts as a booster pump to increase the pressure of the slurry or fluid to a desired pressure before transferring the slurry or fluid to injection pump 402. Next, as the slurry or fluid is pumped through the at least two stages of injection pump 402, the slurry or fluid pressure is further increased until a pre-determined injection pressure and/or pump rate is achieved.

Figure 5:
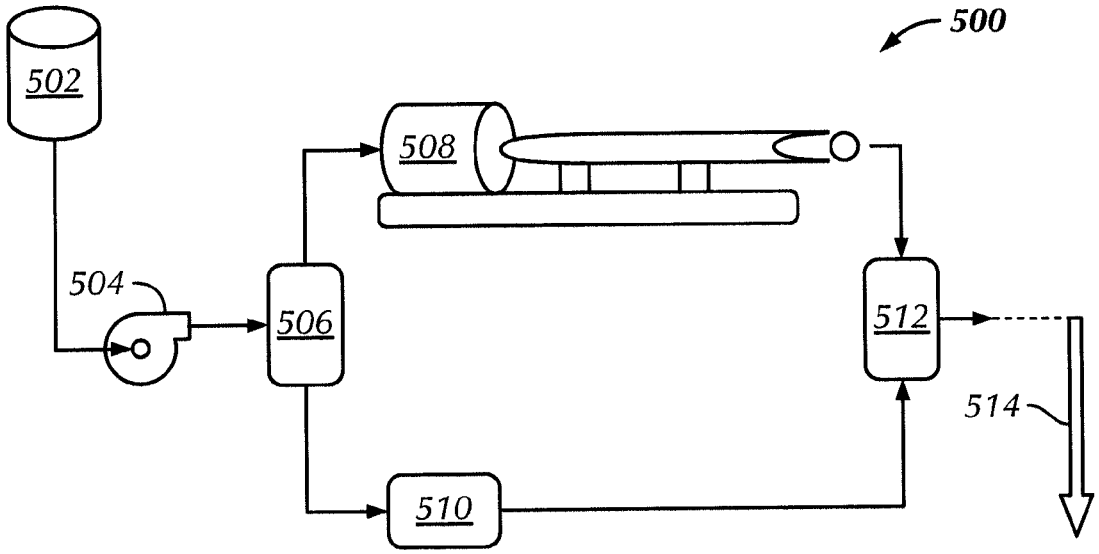
FIG. 5 shows a slurry and/or fluid injection system in accordance with embodiments disclosed herein.

Referring now to FIG. 5, another example of a configuration of an injection system 500 in accordance with embodiments disclosed herein is shown. A tank or storage container 502 may provide fluid and/or slurry to a secondary pump 504. The secondary pump 504 shown is a centrifugal pump, but other types of pumps may also be used. The secondary pump 504 may include a single entrance, a single diffuser, and a single impeller (not independently illustrated). Secondary pump 504 acts like a booster pump to increase the pressure of the fluid and/or slurry to a desired pressure before transferring the fluid and/or slurry through a valve or manifold 506. The valve or manifold 506 may direct the fluid and/or slurry to one or both of injection pumps 508, 510 which may be disposed in parallel. One of ordinary skill in the art will appreciate that two or more pumps may be disposed in parallel without departing from the scope of embodiments disclosed herein. The fluid and/or slurry may then pass from one or both of the injection pumps 508, 510 through a second valve or manifold 512 and into the borehole, as indicated by arrow 514.

The injection pump 508 shown in FIG. 5 is a multi-stage centrifugal pump shown in a horizontal orientation; however, one of ordinary skill in the art will appreciate that a vertically oriented multi-stage centrifugal pump may also be used, as discussed above. One of ordinary skill in the art will appreciate that injection pump 508 may include as many stages as necessary to achieve the desired increase in pressure of the fluid and/or slurry, or pre-determined injection pressure. For example, the multi-stage centrifugal pump may include 2 stages, 5 stages, 15 stages, 17 stages, 19 stages, or any number of stages necessary to provide the desired injection pressure. Additionally, the size of the centrifugal pump and the number of stages of the centrifugal pump may be selected based on the desired pump rate and pressure of the fluid and/or slurry for injection downhole. For example, in addition to the number of stages, the size of the bore of the multi-stage centrifugal pump may be selected to obtain a desired pressure and pump rate. In certain embodiments, the centrifugal pump may have a 4 inch bore, a 6 inch bore, an 8 inch bore, or any other size known and used in the art.

The injection pump 510 shown may be a plunger or piston pump, or any other type of pump known in the art. In certain embodiments, the injection pump 510 may be a duplex or triplex pump. In one embodiment, a fluid having low solids content may be pumped through the multi-stage centrifugal injection pump 508, and a slurry may be pumped through the injection pump 510. As used herein, a low solids content fluid refers to a fluid that may have some suspended particles entrained therein or no solid suspended items. Specifically, in select embodiments, a low solids content fluid may include less than 5 percent solid content for undissolved solids. For dissolved solids, the percent of solid content may be increased, forming saturated and/or oversaturated solutions, until the percent of undissolved solids reaches, for example, 5 percent. Thus, as used herein, low solids content fluids may include both undissolved solids and dissolved solids. As discussed above, the injection pumps 508, 510 may have different sizes and/or stages configured to provide a desired pressure and pump rate. Further, one of ordinary skill in the art will appreciate that, during operation of the injection system 500, either one or both of the injection pumps 508, 510 may be used.

In this embodiment, low solids content fluids such as, for example, polymer-based fluids, xanthan gum-based fluids, biopolymer-based fluids, synthetic polymer-based fluids, hydrocarbon-based fluids, viscous pill-fluids, waste fluids, water-based fluids, water, or salt water, may be pumped through the centrifugal pump while heavier solids content fluids, i.e., slurries, are pumped through a plunger pump. Additionally, in certain embodiments, a low solids content fluid may include unweighted fluid, which means that no weighting material has been added thereto. In one embodiment, the pumps may be run in an alternating sequence while in other embodiments the pumps are run simultaneously.

Figure 6:
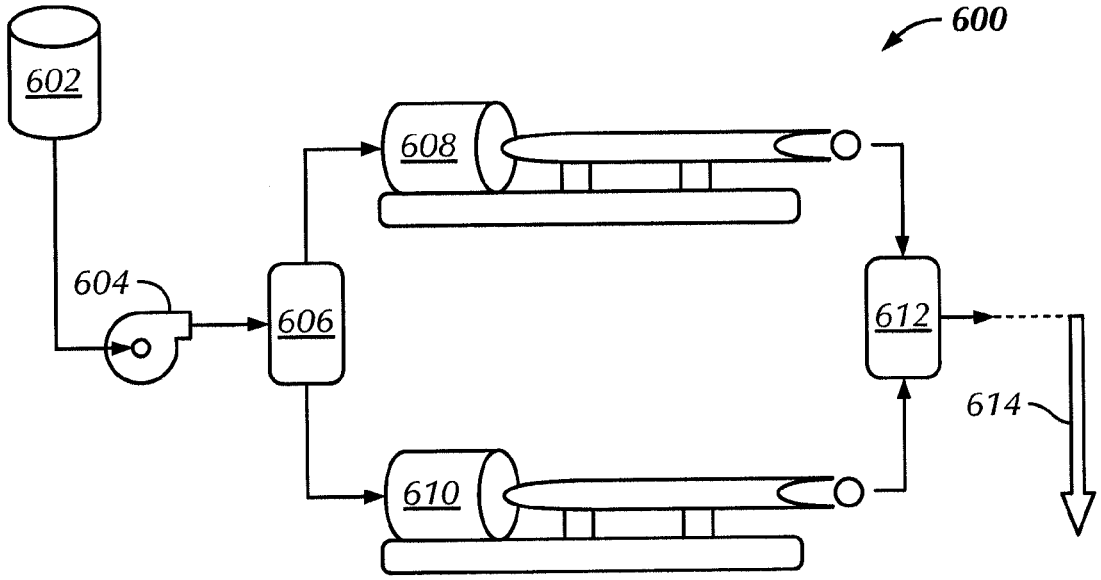
FIG. 6 shows a slurry and/or fluid injection system in accordance with embodiments disclosed herein.
Figure 7:
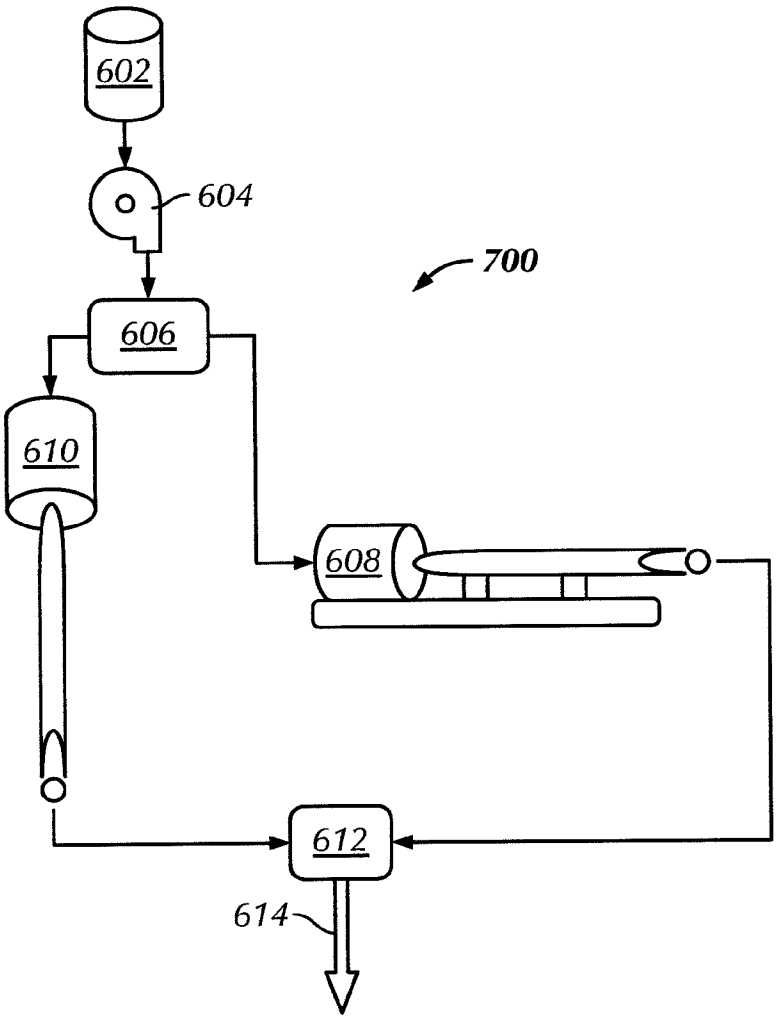
FIG. 7 shows a slurry and/or fluid injection system in accordance with embodiments disclosed herein.

A specific embodiment encompassed by the injection system 500 of FIG. 5 is shown in FIG. 6. In the injection system 600, both injection pumps 608, 610 may be multi-stage centrifugal pumps. One of ordinary skill in the art will appreciate that one or both of the injection pumps 608, 610 may be oriented vertically as shown in FIGS. 7 and 8, respectively. Each stage of the multi-stage centrifugal pumps 608, 610 includes an entrance, a diffuser, and an impeller that rotates and moves the fluid from the entrance to the exit of the stage. As the slurry or fluid flows through each stage, the pressure thereof increases. The two injection pumps 608, 610 may each comprise a different number of stages and may be different sizes as needed to produce desired output pressures. For example, the injection pump 608 may have 2 stages while the injection pump 610 may have 15 stages. Additionally, one of ordinary skill in the art will appreciate that, during operation of the injection system 600, either or both of the injection pumps 608, 610 may be used, as discussed above.

The vertical configuration/placement of the injection pumps 302, 402 shown in FIGS. 3 and 4, and at least one of the injection pumps 608, 610 shown in FIGS. 7 and 8, provides a reduced foot print on the rig deck. In one embodiment, at least one vertically oriented injection pump may be placed on the side of a rig deck with the use of, for example, a slip or guide holder. In this embodiment, injection pumps 302, 402, 608, 610 may require little or no deck space. One of ordinary skill in the art will appreciate that the injection systems 700 and 800 may be easily re-configured to accommodate a vertical or horizontal injection pump of a type other than a multi-stage centrifugal injection pump.

In one embodiment, the shafts, bearings, impellers and/or diffusers of the at least two stages of the multi-stage centrifugal pumps discussed above may be formed from materials known in the art to reduce the wear and increase the life of pump components. For example, the shafts, bearings, impellers and/or diffusers may be formed from a ferritic steel material, a ceramic material or a composite material comprising nickel, chrome, and silicone (i.e., NiResist™, 5530 alloy). Additionally, the impellers and/or diffusers may be coated with a wear-resistant material to reduce wear on the pump components, thereby extending the life of the multi-stage centrifugal pump. For example, a polymer-based coating (e.g., polyurethane), a ceramic coating, or a metal coating (e.g., tungsten carbide) may be applied to the impeller and/or diffuser.

Examples of commercially available multi-stage centrifugal pumps that may be used in accordance with embodiments of the present disclosure include a RedaHPS™ multistage centrifugal pump available from, for example, Schlumberger (Houston, Tex.), Wood Group (Houston, Tex.), or Rentzel Pump Manufacturing (Norman, Okla.), an electrical submersible pump (ESP), or an artificial lift pump. These multi-stage centrifugal pumps may be configured in a horizontal or vertical orientation, as discussed above, as determined by the amount of available rig deck space available. These multi-stage centrifugal pumps may also be coupled to a drive device, such as a direct drive, belt drive, variable speed drive, variable frequency drive, inverter, or gas drive. Additionally, the multi-stage centrifugal pump may be fluidly connected to a tank or vessel containing slurry, such that the slurry may be pumped downhole and injected into the formation fractures.

Testing of an injection system, specifically a cuttings re-injecting system for injecting a slurry, in accordance with embodiments disclosed herein was performed and analyzed. Additionally, a conventional triplex pump was also tested for injecting a slurry into a formation. The test results confirmed that the injection system formed in accordance with embodiments disclosed herein injected viscous and weighted waste slurry in a continuous and smooth manner rather than in a pulsed manner of delivering the slurry provided by the conventional triplex pump. A continuous and smooth injection of the slurry or fluid may be important for production waste injection and may allow injection of a slurry with increased solids content.

The tested system for injection of a slurry into a formation in accordance with the present disclosure included a 44-stage centrifugal pump. The 44-stage centrifugal pump was positioned in a horizontal orientation. The tested 44-stage centrifugal pump system was used to inject high viscosity (i.e., at least 60 second/quart Marsh funnel viscosity) slurry with a density of 1.27 gram/cm$^3$.The slurry injected included particles with an average size range of between 100 microns and 300 microns. An example of the equipment arrangement for the testing system is shown in FIG. 9. A system with a horizontal multi-stage centrifugal pump, indicated at 950, and a conventional system with a triplex pump, indicated at 960, is shown. Additional equipment used in testing the systems may include a slurry unit 952, shakers or other separatory means 954, pneumatic transfer devices 956, storage tanks 958, and an injection manifold 962. Several parameters of the slurry injection systems are shown in Table 1 and parameters of the sea water injection systems are shown in Table 2.

TABLE 1

Parameters for a System using a Triplex Pump and a System using a Centrifugal Pump for Slurry Injection

| Slurry Injection | System using a Triplex Pump | System using a 44-Stage Centrifugal Pump |
|---|---|---|
| Rate of injection of slurry and maximum pressure | 3.4 bpm @ 1000 psi | 7.8 bpm @ 2300 psi |
| Injection time for 600 bbl of slurry | 3 hours | 1 hour 30 min |
| Pump Parameters | Maximum output: 400 BHP<br>Maximum speed: 350 RPM<br>Plunger diameter: 3 in.<br>Stroke length: 6 in.<br>Planetary Gear Ratio: 4.68:1<br>Maximum pressure: 8490 psi | Motor: Toshiba600 HP<br>Length: 32.2 ft.<br>Height: 2.71 ft.<br>Suction: 6 in.<br>Discharge: 4 in.<br>Digital Control: Variable Frequency Drive (VFD) |

TABLE 2

Parameters for a System using a Triplex Pump and a System using a Centrifugal Pump for Sea Water Injection

| Sea Water Injection | System using a Triplex Pump | System using a 44-Stage Centrifugal Pump |
|---|---|---|
| Rate of injection of sea water and maximum pressure | 3.3 bpm @ 2000 psi | 4.2 bpm @ 2200 psi |
| Injection time for 1000 bbl of sea water | 5 hours | 4 hours 40 min |
| Pump Parameters | Maximum output: 400 BHP<br>Maximum speed: 350 RPM<br>Plunger diameter: 3 in.<br>Stroke length: 6 in.<br>Planetary Gear Ratio: 4.68:1<br>Maximum pressure: 8490 psi | Motor: Toshiba 600 HP<br>Length: 32.2 ft.<br>Height: 2.71 ft.<br>Suction: 6 in.<br>Discharge: 4 in.<br>Digital Control: VFD |

During offshore trials, a Reda HPS™ centrifugal pump was used and an OPI Triplex plunger pump was used. Using the parameters listed in Table 1 and Table 2, the injection profiles between the plunger pump system and the centrifugal pump system showed significant differences. For the same volume of fluid (600 bbls slurry/1000 bbls sea water), the centrifugal pump system completed the batch faster. Additionally, the centrifugal pump system maintained an elevated well pressure of at least 2200 psi during the slurry injection. The slurry output of the centrifugal pump system was significantly greater than the standard plunger pump system. It was also noted that the centrifugal pump system required less daily maintenance, and that the digital control of the VFD on the centrifugal pump system allowed precise setting of the pump's output. Samples taken at the outlets of both the centrifugal pump system and the plunger pump system revealed that slurry properties were similar, but that in some cases, the centrifugal pump system produced a slurry with a higher Marsh Funnel viscosity. Higher Marsh Funnel viscosity numbers may create a more stable slurry and may provide benefits including improved ingredients dispersion and improved suspension of solid particles in the polymer matrix of the slurry.

In view of the above, a centrifugal pump system, in accordance with embodiments disclosed herein, may be used for various waste injection applications. For example, a centrifugal pump system may be used to pump slurry downhole. Alternatively, a centrifugal pump system may be used to pump fluids with low solids content. In some embodiments, a plunger pump system may be used in conjunction with a centrifugal pump system, wherein, for example, the plunger pump system is used to pump a slurry downhole and the centrifugal pump system is used to pump a low solids content fluid downhole.

Advantageously, embodiments disclosed herein provide a method and system for fluid and/or slurry injection that may reduce the amount of required rig deck space for both a fluid injection system and fluid holding tanks/vessels. Furthermore, an injection system in accordance with embodiments disclosed herein may be configured in either a horizontal or vertical orientation, thereby providing more flexibility in the arrangement of the system.

Additionally, in certain embodiments, potential installation costs and structural support problems may be minimized, because the deck load or weight of the necessary equipment or components for the cuttings re-injection system may be less than that of conventional fluid injection systems. In certain embodiments, the deck load may be reduced by more than 50 percent as compared to conventional systems. In addition, injection pumps in accordance with embodiments disclosed herein, e.g., multi-stage centrifugal pumps, may require less up-front cost (e.g., a 20 percent reduction) and shorter up-front delivery times (e.g., 25 percent reduction) than other injection pumps, e.g., plunger pumps.

Injection pumps for fluid or slurry injection in accordance with embodiments disclosed herein may provide extended run times due to the unique impeller/diffuser staging system of a multi-stage centrifugal pump, which may be calculated in terms of years rather than days or months of conventional injection pumps. Additionally, drilling wastes or slurries with higher viscosity (e.g., approximately 100 cP or higher) and higher density (e.g., approximately 1.15 gram/cm3 or higher) than waste injected by conventional systems may be injected into a formation with the system and equipment formed in accordance with the present disclosure. Maintenance of an injection pump in accordance with embodiments disclosed herein may also be faster and more efficient, as the time to replace parts or change out the pump may be shorter. Thus, downtime of an injection pump due to maintenance may be minimized and run life extended.

Further, an injection pump in accordance with embodiments disclosed herein may improve the QHSE (quality, health, safety, and environment) of an injection system, because it may eliminate the hammering or pulsation of conventional high pressure lines, plunger pumps, and injection pump systems, thereby reducing wear on the equipment. An injection system in accordance with embodiments disclosed herein may also be more consistent in use, allowing less reliance on outside expertise. Additionally, an injection pump as discussed above may advantageously be powered by various kinds of drive systems, for example, VFD, direct by electric, diesel, or hydraulic, or remotely. In certain embodiments, the injection system may be remotely monitored and/or controlled using an office live-feed of the system activities.

Fluid injection systems in accordance with embodiments described herein may also advantageously provide more sensitive formation injection than a conventional plunger pump injection system. In particular, because an injection pump system in accordance with embodiments discussed above includes a multi-stage centrifugal pump, the flow of slurry or fluid may be continuous and smooth, rather than pulsating. Because a multi-stage injection pump, as described above, provides for a continuous flow of slurry or fluid, injection time may be reduced and the size of a slurry or fluid holding tank/vessel may also be reduced, further reducing required deck space. Additionally, the smooth flow of slurry or fluid may increase the receiving capacity of the receiving formation by maintaining sufficient fractures, thereby increasing permeability of the receiving formation.

Further, economic advantages may be provided by an injection system that uses centrifugal pumps for fluids, and duplex or triplex pumps for slurries. Centrifugal pumps may be used to inject fluids that have low solids content without sustaining significant damage to the centrifugal pump components. Similarly, duplex or triplex pumps may be used to inject slurries that have high solids content without subjecting the duplex or triplex pump components to extensive and destructive wear. A system using at least one centrifugal pump may require less maintenance and, thus, reduced labor and downtime for maintenance. As a result, improved HSE conditions, in addition to time and cost savings, may be achieved.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method of injecting a fluid downhole, the method comprising:

diverting a fluid along a common flow path to one of a centrifugal pump and a plunger pump, the plunger pump disposed in the common flow path parallel to the centrifugal pump, wherein the fluid comprises one of a first solids fluid having less than 5 percent undissolved solids and a second solids fluid having greater than 5 perfect undissolved solids;

pumping the fluid through one of the centrifugal pump and the plunger pump, the pumping comprising increasing the pressure of the fluid to an injection pressure greater than a well pressure, wherein the first solids fluid is diverted and pumped through the centrifugal pump and the second solids fluid is diverted and pumped through the plunger pump; and injecting the pressurized fluid into a wellbore.

2. The method of claim 1, further comprising:

providing a third injection pump disposed upstream of the centrifugal pump and the plunger pump; and pumping the fluid through the third injection pump to at least one of the centrifugal pump and the plunger pump.

3. The method of claim 1, wherein the first solids fluid comprises at least one of a group consisting of biopolymer-based fluid, xanthan gum-based fluid, synthetic polymer-based fluid, polymer-based fluid, hydrocarbon-based fluid, water-based fluid, water, and salt water.

4. The method of claim 1, wherein the first solids solids content fluid is unweighted.

5. The method of claim 1, wherein the centrifugal pump provides a continuous flow of slurry.

6. The method of claim 1, wherein the plunger pump provides a pulsating flow of fluid.

7. A system for injecting a fluid into a formation comprising:

a first manifold having an outlet;

a centrifugal pump having at least two stages;

a plunger pump disposed in parallel with the centrifugal pump; and a second manifold having an inlet;

the outlet of the first manifold fluidly connected to an inlet of the centrifugal pump and an inlet of the plunger pump;

the inlet of the second manifold fluidly connected to an outlet of the centrifugal pump and an outlet of the plunger pump further comprising valves for selectively diverting a first solids fluid have an undissolved solids content under a threshold to the centrifugal pump and a second solids fluid having an undissolved solids content over the threshold to the plunger pump.

8. The system of claim 7, wherein the centrifugal pump has between 10 and 60 stages.

9. The system of claim 8, wherein the centrifugal pump has 44 stages.

10. The system of claim 7, wherein the centrifugal pump and the injection pump are oriented horizontally.

11. The system of claim 7, wherein the centrifugal pump and the injection pump are oriented vertically.

* * * * *